US007608768B2

(12) United States Patent
Thanyakij

(10) Patent No.: US 7,608,768 B2
(45) Date of Patent: Oct. 27, 2009

(54) INJECTION MOLDED SAXOPHONE

(76) Inventor: Piyapat Thanyakij, 38 Soi 4, Navathanee, Sereethai Road, Kannayao, Bangkok (TH) 10230

( * ) Notice: Subject to any disclaimer, the term of this patent is extended or adjusted under 35 U.S.C. 154(b) by 0 days.

(21) Appl. No.: 12/038,982

(22) Filed: Feb. 28, 2008

(65) Prior Publication Data

US 2008/0202314 A1 Aug. 28, 2008

(30) Foreign Application Priority Data

Feb. 28, 2007 (TH) ..... 0701000922
Feb. 28, 2007 (TH) ..... 0701000923

(51) Int. Cl.
*G10D 9/04* (2006.01)

(52) U.S. Cl. ..... 84/385 R; 84/380 R; 84/382

(58) Field of Classification Search ..... 84/385 R, 84/380 R, 382
See application file for complete search history.

(56) References Cited

U.S. PATENT DOCUMENTS 329,940 A * 11/1885 Oesterle ..... 84/380 R
2,033,774 A * 3/1936 Loomis ..... 84/385 R
2,471,290 A * 5/1949 Sommaruga ..... 84/385 R
2,533,389 A * 12/1950 Meyers ..... 84/385 R
2,551,177 A * 5/1951 Sommaruga ..... 84/385 R
2,569,029 A * 9/1951 Sylvester ..... 84/385 R
2,730,003 A * 1/1956 Loney ..... 84/380 R
3,127,806 A * 4/1964 Fox ..... 84/380 R
3,264,925 A * 8/1966 Linton, Sr. ..... 84/380 R
3,308,707 A * 3/1967 Kelischek ..... 84/380 C
3,375,746 A * 4/1968 Proll ..... 84/380 R
3,561,905 A * 2/1971 Linton, Sr. ..... 84/380 R
3,657,464 A * 4/1972 Pascucci ..... 84/380 R
3,747,460 A * 7/1973 Robbins ..... 84/382

(Continued)

OTHER PUBLICATIONS

The Grafton Alto Saxophone, Built in 1951, details about the instrument and photos of the working parts, broken down, viewed Feb. 11, 2009 at www.xs4all.nl/~lexlub/chromata-ic_eng/grafton/grafton.htm.*

(Continued)

*Primary Examiner*—Jeffrey Donels
*Assistant Examiner*—Robert W Horn
(74) *Attorney, Agent, or Firm*—McDonnell Boehnen Hulbert & Berghoff LLP

(57) ABSTRACT

An injection molded saxophone. A main frame of the saxophone comprises a number of injection molded parts. The injection molded parts are namely a neck, an upper body, a main body, a left bell and bow and a right bell and bow. The injection molded parts are preferably made from a substantially plastic polymer. The neck comprises an octave vent for allowing moisture removal. At least one of the injection molded parts has a number of holes formed therein. A keyworks assembly is couplable to the main frame. The keyworks assembly comprises a number of tone hole cover structures, a number of keys and a number of rods. Each tone hole cover structure comprises a lid shaped for covering its corresponding hole. Each tone hole cover structure has an end ring with an end hole that is shaped and dimensioned to fit with an external profile of one of the number of rods. Operation of the rod varies at least one hole between the open state and the closed state to thereby vary pitch of generated sound.

22 Claims, 10 Drawing Sheets

U.S. PATENT DOCUMENTS

| | | | | | |
|---|---|---|---|---|---|
| 3,750,521 | A * | 8/1973 | Dolmetsch | 84/380 C |
| 3,805,665 | A * | 4/1974 | Oouchi | 84/380 C |
| 4,306,484 | A * | 12/1981 | Toyama | 84/380 R |
| 4,669,351 | A * | 6/1987 | Ono | 84/380 R |
| 4,998,456 | A * | 3/1991 | Kahonen | 84/384 |
| 5,027,685 | A * | 7/1991 | Lenz | 84/330 |
| 5,375,498 | A * | 12/1994 | Obuchi | 84/380 R |
| D360,904 | S * | 8/1995 | Schilling | D10/119 |
| 5,736,662 | A * | 4/1998 | Spector | 84/600 |
| 6,239,342 | B1 * | 5/2001 | Chang | 84/422.1 |
| 6,696,629 | B1 * | 2/2004 | Cooper, Jr. | 84/385 R |
| 6,794,564 | B2 * | 9/2004 | Louis | 84/385 R |
| 6,822,149 | B1 * | 11/2004 | Liao | 84/422.1 |
| 6,852,917 | B2 * | 2/2005 | McAleenan | 84/380 R |
| 7,078,605 | B2 * | 7/2006 | Love | 84/398 |
| 7,179,977 | B1 * | 2/2007 | Kelly | 84/398 |
| 7,301,088 | B2 * | 11/2007 | Chen | 84/422.1 |
| 7,375,270 | B2 * | 5/2008 | Abernethy | 84/380 R |
| 7,439,429 | B2 * | 10/2008 | Wood et al. | 84/385 R |
| 2003/0015082 | A1 * | 1/2003 | Brennan | 84/380 R |
| 2003/0075035 | A1 * | 4/2003 | Ross et al. | 84/380 B |
| 2004/0031374 | A1 * | 2/2004 | Cooper, Jr. | 84/385 R |
| 2007/0113721 | A1 * | 5/2007 | Kelly | 84/398 |
| 2008/0202314 | A1 * | 8/2008 | Thanyakij | 84/385 R |
| 2008/0223193 | A1 * | 9/2008 | Miyaoka | 84/380 R |

OTHER PUBLICATIONS

Grafton saxophone, production commenced in 1950, more history and commentary, viewed Feb. 11, 2009 at http://en.wikipedia.org/wiki/Grafton_saxophone.*

* cited by examiner

INJECTION MOLDED SAXOPHONE

FIELD OF INVENTION

The present invention relates generally to musical instruments. More particularly, the present invention relates to an injection molded saxophone and a method for its manufacture.

BACKGROUND

Musical instruments, for example saxophones, flutes, trumpets and trombones are commonly made or manufactured from metal and metal alloys. A commonly used metal alloy is brass. Brass is a composite metal alloy that is made up of differing proportions of metals including copper, tin, nickel and zinc.

A significantly high level of skill is required for working metal and metal alloys such as brass. Consequently, manufacture of metallic musical instruments, for example brass musical instruments, typically requires highly skilled and experienced craftsmen. However, there is a lack of highly skilled and experienced craftsmen in many countries of the world. Therefore, it is often necessary in such countries to import metallic musical instruments so as to meet domestic demand.

An increasing demand for quality metallic musical instruments coupled with a deficiency in number of highly skilled and experienced craftsmen significantly raise retail prices of metallic musical instruments. The raised retail prices of metallic musical instruments make such instruments unaffordable to a significant proportion of the countries' population. Accordingly, there is an urgent need to reduce cost of manufacture and consequent retail prices of metallic musical instruments so as to increase affordability of the metallic musical instruments.

In addition, metals and metal alloys, including brass, are generally heavy. The considerable weight of metals and metal alloys makes such materials difficult to work with and to handle. Musical instruments constructed from metals or metal alloys will also require a significantly greater strength during transportation.

Metals and metal alloys, including brass, are typically prone to corrosion and deformation due to impact. Musical instruments made from such materials are often lacquer coated to minimize corrosion. However, it has been proposed that the lacquer coating has an adverse effect on the musical instruments' sound or pitch quality. Accordingly, there is a remaining need for a lighter and more durable construction material for musical instruments that, at the same time, will not adversely affect the quality of sound or pitch produced.

Musical instruments, in particular reed instruments such as saxophones, are generally composed of numerous individual parts that are assembled together. A typical saxophone has two main parts: a body, and a neck that is attached to an end of the body. The body of the saxophone is a substantially conically shaped brass tube with posts or plates soldered onto it. The posts or plates support a number of rods (also known as tubes), keys and tone hole cover structures. The rods of the saxophone are considered important because they support and facilitate all movement of the keys and pads that are associated with the playing of the saxophone. The pads are used to cover holes that are formed in the body of the saxophone. The keys and the pads are inter-connectable via the rods.

During play of the saxophone, a musician typically operates the keys to thereby displace the inter-connected pads away from or towards corresponding holes for respectively opening or closing the corresponding holes. Different combinations of opened and closed holes facilitate production of differing pitch of sound produced during play of the saxophone.

Typically, each of the numerous individual parts of the saxophone needs to be in a correct proportion and size to facilitate accurate assembly of the saxophone. A small error in the proportion and size of a single part of the saxophone can result in the assembly of a poor quality or an unusable saxophone. Conventionally, the numerous individual parts of the saxophone are welded or soldered together manually during assembly. Due to significantly large numbers of individual parts, the manual welding process is typically very time consuming. Additionally, manual manufacture of the saxophone introduces a possibility of human error during construction and assembly of the saxophone.

It is therefore apparent that the construction and assembly of each of the numerous individual parts of the saxophone, as well as of musical instruments in general, typically require considerable skill, time, labor and cost. Accordingly, there is a continuous need to refine and improve manufacturing processes of musical instruments. Additionally, there is also a remaining need for widely affordable, lightweight and durable musical instruments, particularly reed musical instruments such as the saxophone.

SUMMARY

In accordance with a first aspect of the invention, there is disclosed a reed instrument comprising a main frame defining a bore and having a plurality of holes formed therein for fluid communication with the bore. The main frame is formed from a plurality of parts that are shaped and dimensioned for intercouplability and for defining shape of the main frame. Each of the plurality of parts is formed by injection molding. The reed instrument further comprises a keyworks assembly couplable to the main frame, the keyworks assembly comprising a plurality of rods and a plurality of tone hole cover structures. Each of the plurality of rods has an off-circular length transverse cross-sectional shape. Each of the plurality of tone hole cover structures comprises a lid that is shaped and dimensioned for covering a corresponding one of the plurality of holes. At least one of the plurality of tone hole cover structures has an end hole which shape matches the cross-sectional shape of at least one of the plurality of rods. The at least one of the plurality of tone hole cover structures is fitted to the at least one of the plurality of rods and displaceable one of towards and away from at least one of the plurality of holes corresponding thereto by operating the at least one of the plurality of rods for varying the at least one of the plurality of holes to one of a closed state and an open state respectively. The reed instrument when in use, air is displaceable through the bore of the main frame for generating sound therefrom, and the at least one of the plurality of rods is operable for varying at least one of the plurality of holes to one of the open state and the closed state to thereby vary pitch of the generated sound.

In accordance with a second aspect of the present invention, there is disclosed a method for manufacturing a reed instrument, the method comprising injection molding a plurality of reed instrument parts and assembling the plurality of reed instrument parts to form a main frame, the main frame defining a bore and having a plurality of holes formed therein for fluid communication with the bore. The method further comprises coupling a keyworks assembly to the main frame, the keyworks assembly comprising a plurality of rods and a plurality of tone hole cover structures. Each of the plurality of rods has an off-circular length transverse cross-sectional shape. Each of the plurality of tone hole cover structures comprises a lid that is shaped and dimensioned for covering a corresponding one of the plurality of holes. At least one of the plurality of tone hole cover structures has an end hole which shape matches the cross-sectional shape of at least one of the plurality of rods. The at least one of the plurality of tone hole cover structures being fitted to the at least one of the plurality of rods is also displaceable one of towards and away from at least one of the plurality of holes corresponding thereto by operating the at least one of the plurality of rods for varying the at least one of the plurality of holes to one of a closed state and an open state respectively. During use of the reed instrument manufacture by the method, air is displaceable through the bore of the main frame for generating sound therefrom, and the at least one of the plurality of rods is operable for varying at least one of the plurality of holes to one of the open state and the closed state to thereby vary pitch of the generated sound.

In accordance with a third aspect of the present invention, there is disclosed a main frame of a reed instrument. The main frame comprises a plurality of parts made substantially by injection molding. Each of the plurality of parts is shaped and dimensioned for intercouplability. The plurality of parts is intercoupled for defining a bore, the intercoupled plurality of parts having a plurality of holes formed therein. Each of the plurality of holes is for fluid communication with the bore. The intercoupled plurality of parts is couplable to a keyworks assembly, the keyworks assembly comprising a plurality of rods and a plurality of tone hole cover structures. Each of the plurality of rods has an off-circular length transverse cross-sectional shape. Each of the plurality of tone hole cover structures comprises a lid that is shaped and dimensioned for covering a corresponding one of the plurality of holes. At least one of the plurality of tone hole cover structures has an end hole which shape matches the cross-sectional shape of at least one of the plurality of rods. The at least one of the plurality of tone hole cover structures being fitted to the at least one of the plurality of rods is also displaceable one of towards and away from at least one of the plurality of holes corresponding thereto by operating the at least one of the plurality of rods for varying the at least one of the plurality of holes to one of a closed state and an open state respectively. The reed instrument when in use, air is displaceable through the bore of the main frame for generating sound therefrom, and the at least one of the plurality of rods is operable for varying at least one of the plurality of holes to one of the open state and the closed state to thereby vary pitch of the generated sound.

In accordance with a fourth aspect of the present invention, there is disclosed a saxophone comprising a main frame defining a bore and having a plurality of holes formed therein for fluid communication with the bore. The main frame of the saxophone is formed from a plurality of parts that are shaped and dimensioned for intercouplability and for defining shape of the main frame, each of the plurality of parts being formed by injection molding. The saxophone further comprises a keyworks assembly couplable to the main frame. The keyworks assembly comprises a plurality of rods and a plurality of tone hole cover structures. Each of the plurality of rods has an off-circular length transverse cross-sectional shape. Each of the plurality of tone hole cover structures comprises a lid that is shaped and dimensioned for covering a corresponding one of the plurality of holes. At least one of the plurality of tone hole cover structures has an end hole which shape matches the cross-sectional shape of at least one of the plurality of rods. The at least one of the plurality of tone hole cover structures that is fitted to the at least one of the plurality of rods is displaceable one of towards and away from at least one of the plurality of holes corresponding thereto by operating the at least one of the plurality of rods for varying the at least one of the plurality of holes to one of a closed state and an open state respectively. When the saxophone is in use, air is displaceable through the bore of the main frame for generating sound therefrom, and the at least one of the plurality of rods is operable for varying at least one of the plurality of holes to one of the open state and the closed state to thereby vary pitch of the generated sound.

BRIEF DESCRIPTION OF THE DRAWINGS

Embodiments of the invention are described hereinafter with reference to the following drawings in which.

DETAILED DESCRIPTION

Musical instruments, particularly reed musical instruments such as saxophones, are typically manufactured from metal alloys such as brass. However, brass musical instruments are significantly heavy. Brass musical instruments are also prone to corrosion and distortion. Highly skilled craftsmen are typically required for working brass. An insufficient number of such highly skilled craftsmen increases manufacturing cost and eventual retail price of such brass musical instruments.

Furthermore, musical instruments, particularly reed musical instruments such as saxophones, generally comprise a significant number of individual parts. Construction and assembly of each individual part often requires considerable skill, time, labor and cost. Accordingly, there is a continuous need to refine and improve manufacturing processes of musical instruments, including that of the saxophone. There is also a need for musical instruments, for example saxophones, which are simultaneously of high quality, widely affordable, lightweight and durable.

For purposes of brevity and clarity, descriptions of embodiments of the present invention are limited hereinafter to reed instruments, and more specifically to a saxophone. This however, does not preclude various embodiments of the invention from other specific applications where fundamental principals prevalent among the various embodiments of the invention such as operational, functional or performance characteristics are required.

An exemplary embodiment of the present invention, a saxophone 10 comprising a number of parts made preferably by injection molding is described hereinafter with reference to FIG. 1 to 7.

Figure 1:
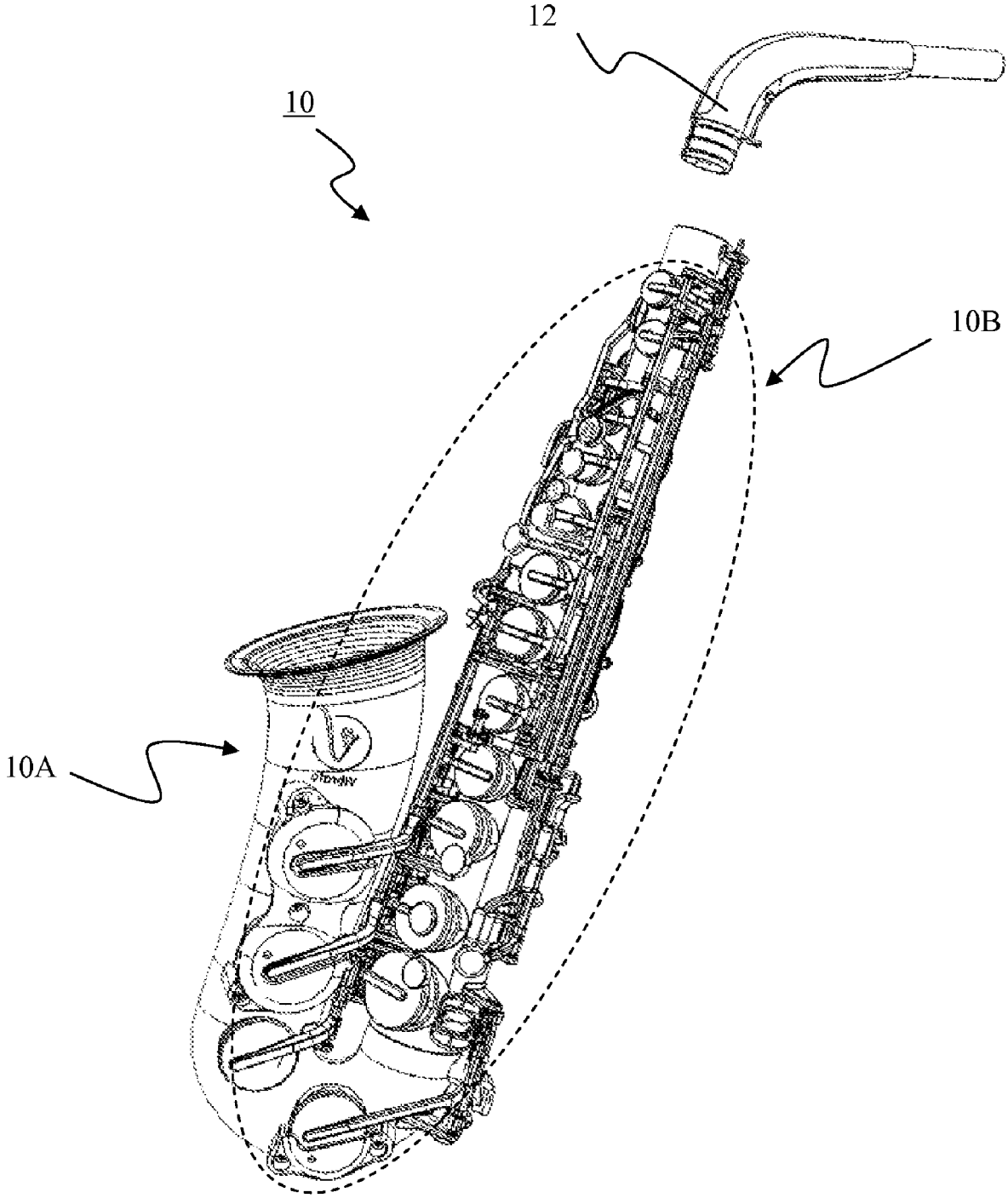
FIG. 1 illustrates a saxophone according to an embodiment of the present invention.
Figure 2A:
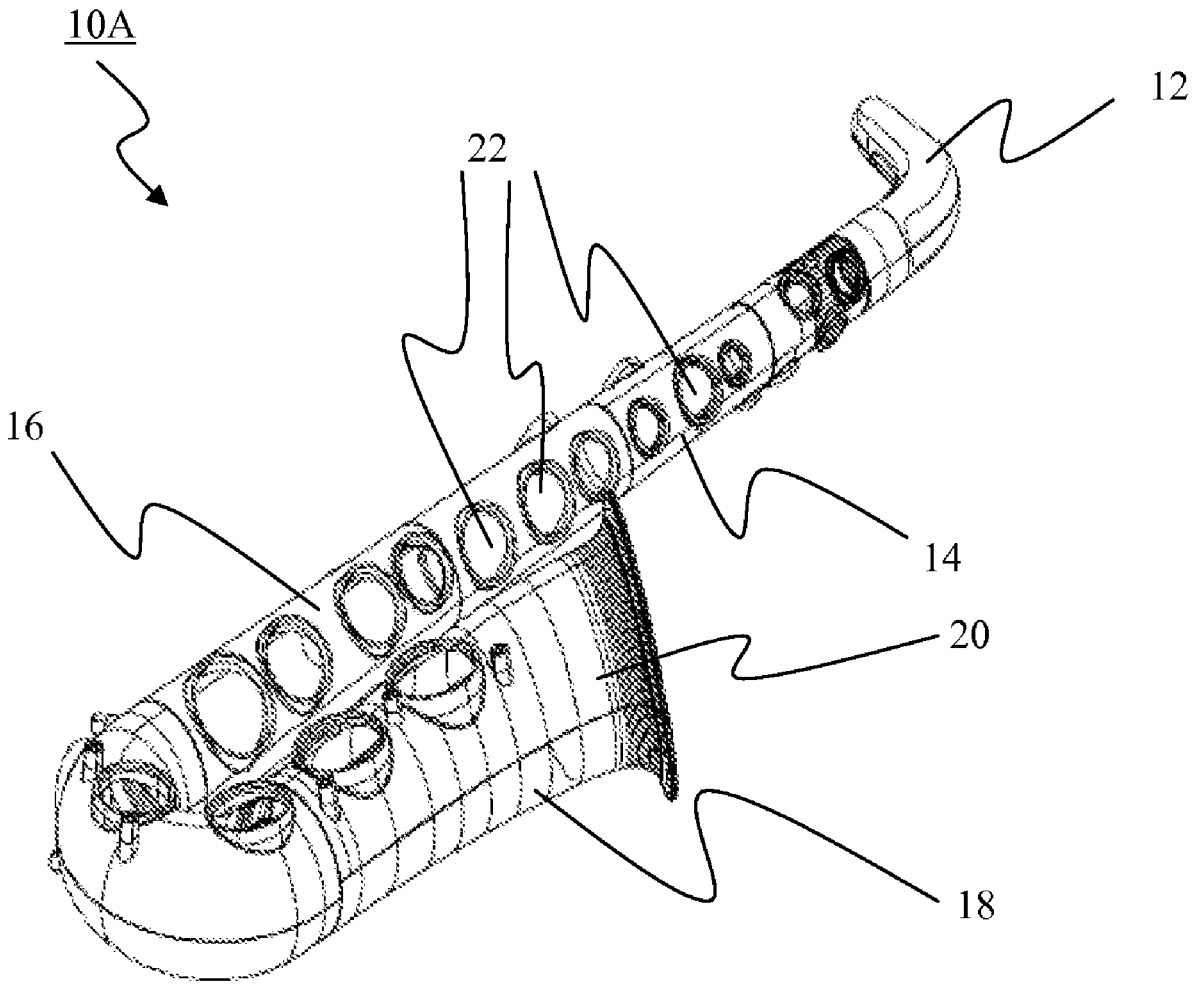
FIG. 2*a* shows an isometric view of a main frame of the saxophone of FIG. 1.
Figure 2B:
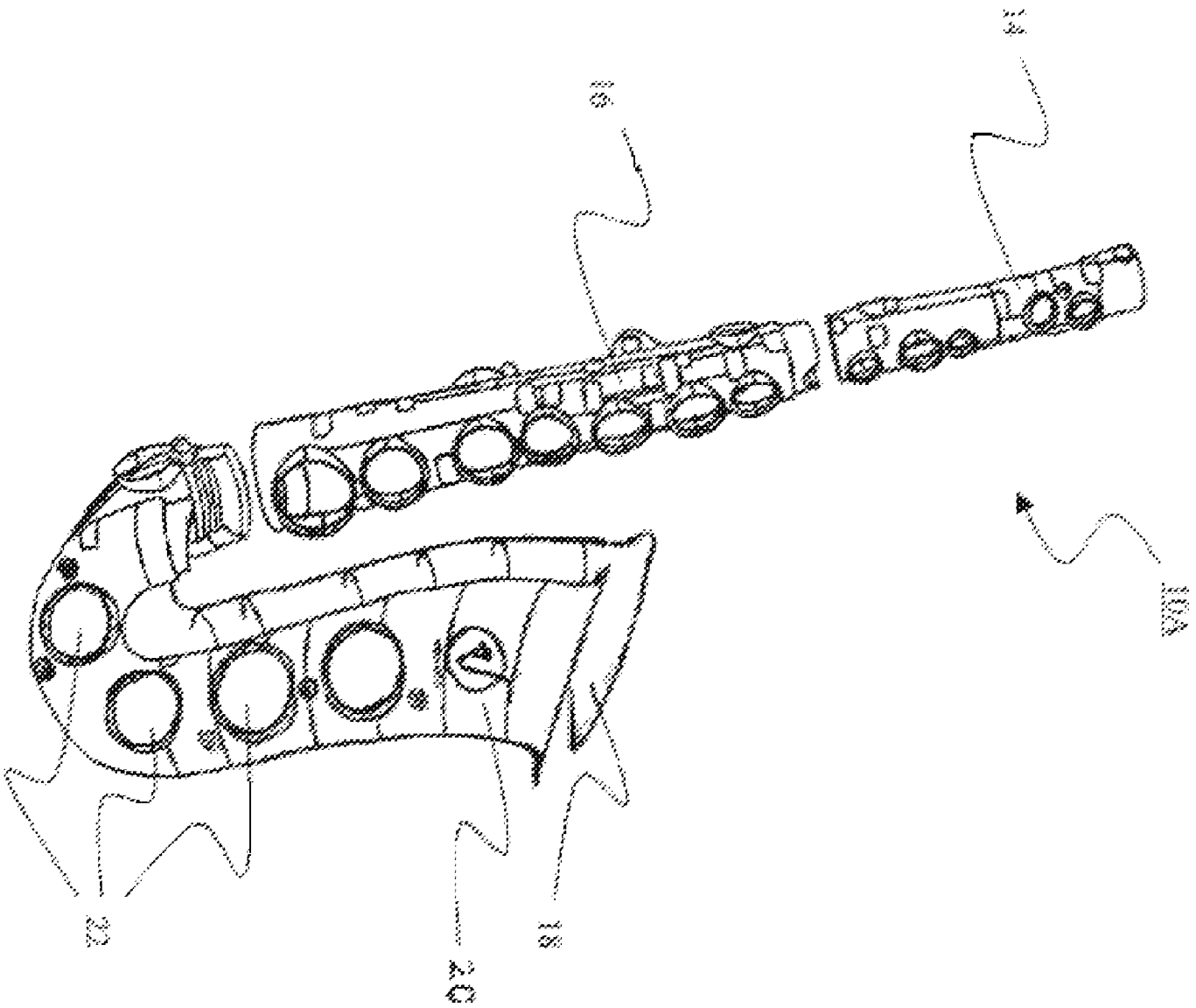
FIG. 2*b* shows an exploded view of the main frame of the saxophone of FIG. 1.
Figure 3:
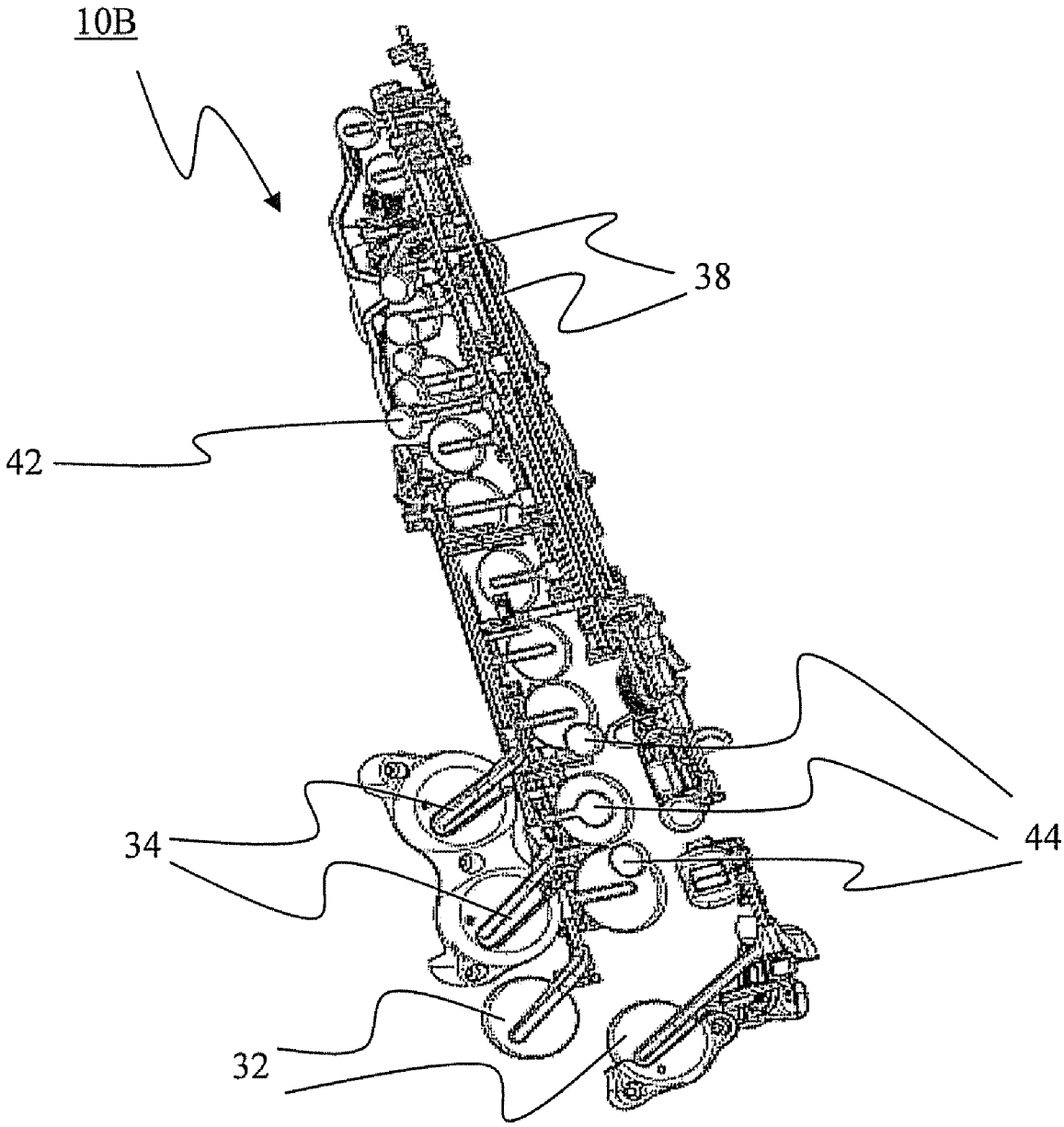
FIG. 3 shows an isometric view of a keyworks assembly of the saxophone of FIG. 1.

The saxophone 10 is clearly illustrated in FIG. 1. Generally, the saxophone 10 comprises a main frame 10A, further illustrated in FIG. 2*a* and FIG. 2*b*, and a keyworks assembly 10B, further illustrated in FIG. 3. A neck 12 is preferably removably attachable to the main frame 10A.

The main frame 10A comprises a number of main parts, namely, an upper body 14, a main body 16, a left bell and bow 18 and a right bell and bow 20. Preferably, the main parts are shaped and dimensioned for enabling inter-assembly to form the main frame 10A. The main frame 10A is shaped for defining a central bore therethrough.

The main frame 10A comprises a number of holes, hereinafter referred to as tone holes 22. Each of the tone holes 22 has a specifically defined size and is formed in any of the main parts of the saxophone 10. The specifically defined size of the tone holes 22 is important for determining a sound or a tone produced during play of the saxophone 10.

Each of the main parts is preferably formed within an individual mold. Alternatively, two or more of the main parts can be formed together within one mold. Preferably, the mold is made of metal. Alternatively, the mold is made of an alloy, a non-metallic material or a metal-reinforced material having heat-resistant properties. The keyworks assembly 10B is an assembly of a number of keyworks and comprises a number of tone hole cover structures 30, a number of rods 38 and a number of keys. Each of the number of tone hole cover structures 30 is for covering its corresponding tone hole 22.

Figure 4:
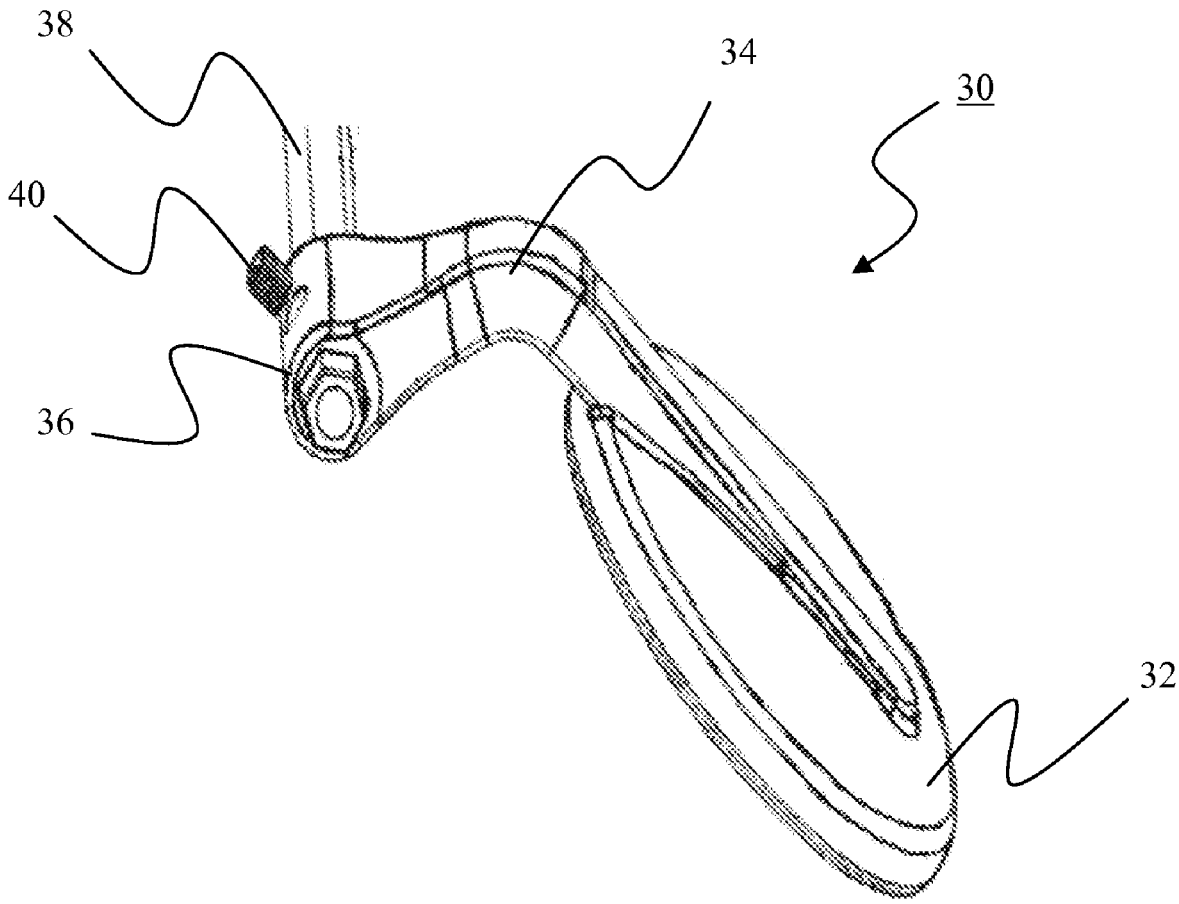
FIG. 4 shows an isometric view of a tone hole cover structure, which is attached to a rod of the saxophone of FIG. 1.
Figure 5:
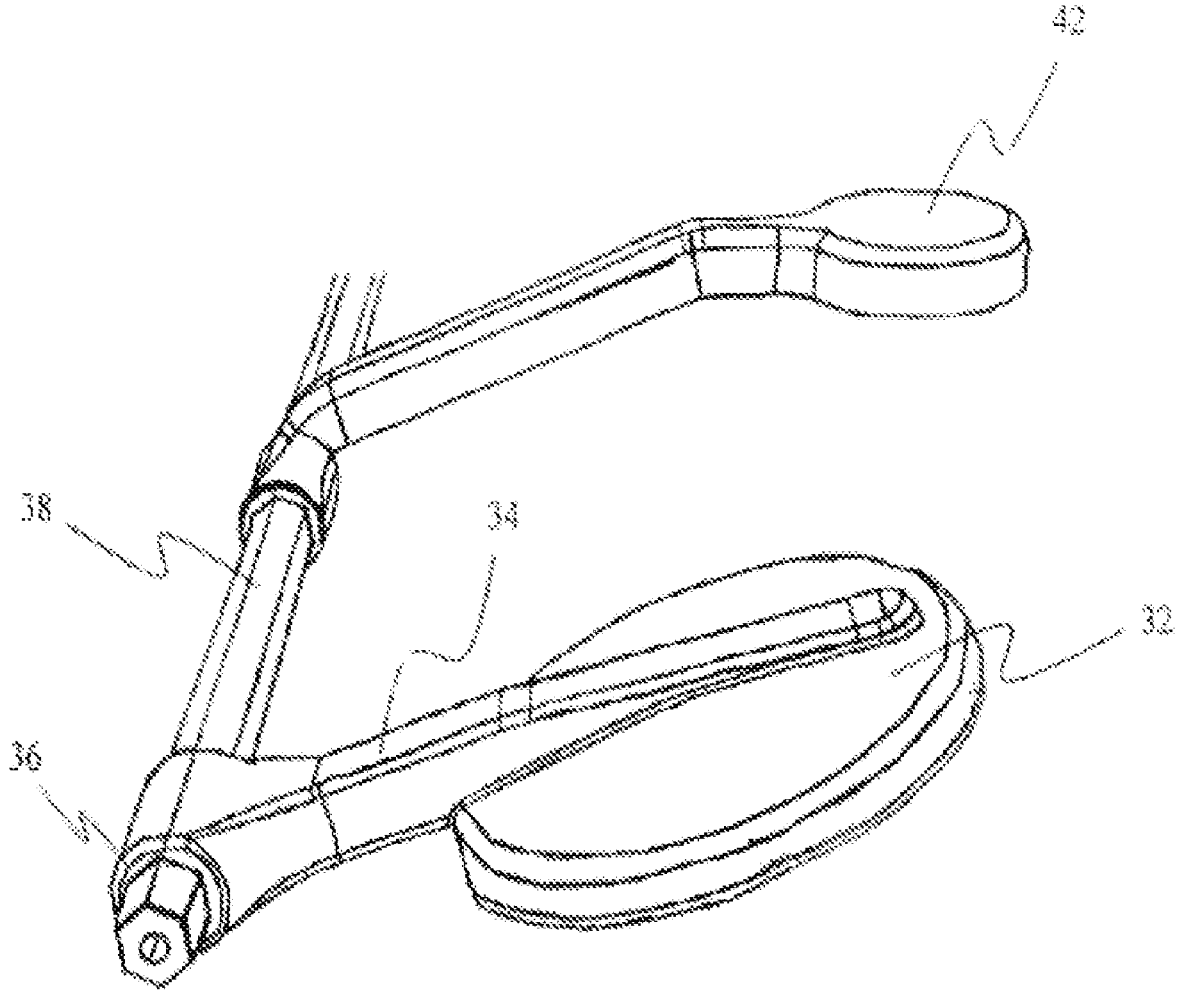
FIG. 5 shows an isometric view of the tone hole cover structure and an isolated key attached to the rod of FIG. 4.

As further illustrated in FIG. 4, the tone hole cover structure 30 preferably comprises a circular lid 32, a stem 34 and an end ring 36. The circular lid 32 of each of the number of tone hole cover structure 30 is preferably shaped, dimensioned and disposed for covering the corresponding one of the number of tone holes 22. Preferably, each circular lid 32 comprises a pad located on its underside. The pad is preferably made of rubber. Rubber is waterproof and therefore enhances durability of the pad. Alternatively, the pad is made of leather. The pad also functions as a gasket or a seal.

The stem 34 of each of the number of tone hole cover structures 30 is preferably elongated. The stem 34 extends from the circular lid 32 and terminates at the end ring 36. The end ring 36 forms or defines a ring hole or opening. The ring hole is preferably hexagonal in shape. Alternatively, the ring hole is of a different geometric shape, for example a triangle, a square, a pentagon or an octagon.

The tone hole cover structure 30 is preferably substantially made from a plastic polymer. Alternatively, the tone hole cover structure 30 is substantially made from a metal, a metal alloy or a heat-resistant synthetic material.

The keyworks assembly 10B comprises a number of rods 38. Preferably, at least one tone hole cover structure 30 is attached to each of the number of rods 38.

More specifically, the at least one tone hole cover structure 30 is attached to each of the number of rods 38 via the ring hole in the end ring 36.

Preferably, the rod 38 has a substantially hexagonal external profile for shape matching the ring hole of each tone hole cover structure 30. Alternatively, the rod 38 has a substantially triangular, square, pentagonal or octagonal external profile for shape matching the ring hole of each tone hole cover structure 30. The substantially hexagonal external profile of the rod 38 enables the rod 38 to fit through the ring hole. Additionally, the substantially hexagonal external profile of the rod 38 restricts free rotation of the rod 38 within the ring hole.

As previously mentioned, more than one tone hole cover structure 30 is attachable to each rod 38. Preferably, a movement or displacement of each rod 38 enables collective or concurrent movement of multiple tone hole cover structures 30 that are attached to the rod 38.

The rod 38 is preferably made from aluminum. Alternatively, the rod 38 is made from other metals or metal alloys, for example brass, bronze, silver, iron or steel.

The ring hole of the end ring 36 of the tone hole cover structure 30 is preferably specifically shaped and dimensioned to fit around the external profile of the rod 38. Preferably, the end ring 36 of each tone hole cover structure 30 is secured to its corresponding rod 38 by interference fitting. The interference fitting substantially restricts free travel of the tone hole cover structure 30 along the length of the rod 38. Alternatively, a small screw 40 is used for securing the tone hole cover structure 30 to the rod 38. Further alternatively, an adhesive, for example glue, is used to secure the tone hole cover structure 30 to the rod 38.

The rod 38 can have a hollow extending through its length. A number of shafts (not shown) may be housed within the hollow of the rod 38. The shafts are preferably made from stainless steel. Alternatively, the shafts are made from materials including, but not limited to, metals and metal alloys such as steel, brass, bronze, iron, copper, lead and silver. The shafts are preferably for strengthening and improving rigidity of the rod 38.

The use of shape-matched rod's external profile with the shape of the ring hole, coupled with application of one or more of interference fitting, screws 40 and adhesives as aforementioned removes the conventional need for welding or soldering to securely attach a conventional pad to a conventional rod, and also enables substantially non-destructive disassembly of the tone hole cover structures 30 from the rods 38. As the welding and soldering processes are typically significantly time and skill dependent, elimination of these conventional processes will contribute in reducing manufacturing time and cost. This in turn could potentially allow the retail price of the saxophone 10 to be decreased.

The keyworks assembly 10B further comprises a number of keys. Preferably the keyworks assembly 10B has nine keys. Each key is preferably attached to one of the number of rods 38. Each key is also preferably biased in a rest position. Each key is either a separate entity from the tone hole cover structure 30, and therefore known as an isolated key 42 shown in FIG. 5, or is fused to one of the number of tone hole cover structures 30, and therefore known as an attached key 44. The isolated key 42 is interconnected with the at least one of the number of tone hole cover structures 30 via the rod 38 that the isolated key 42 is attached to.

As previously mentioned, the keyworks assembly 10B is an assembly of a number of keyworks. Each of the number of keyworks either comprises one key and one tone hole cover structure 30 or one key and two or more tone hole cover structures 30. The rods 38 connect the key with the one or more tone hole cover structure 30. As previously mentioned, the rods 38 can be hollow or without a hollow. Physical structure of the rod 38 is preferably dependent on specifications or requirements of individual manufacturers.

During play of the saxophone 10, a musician typically applies force to one or more key for displacement of the one or more key from the rest position. The applied force causes the one or more key to move and be displaced away from the rest position. The displacement of the one or more key displaces the corresponding rod 38 and consequently displaces the one or more tone hole cover structures 30, and hence the one or more circular lids 32, attached to the corresponding rod 38. The displaced one or more tone hole cover structures 30, more specifically the displaced one or more circular lids 32, opens or closes one or more tone holes 22 in the main frame 10A.

Production of sound by the saxophone 10 typically requires air to be introduced into the saxophone 10, more specifically into the central bore formed by the main frame 10A. Typically, air is introduced via a mouthpiece (not shown) that is attached to the neck 12. Entry of air, coupled with combinations of opened and closed tone holes 22 results in production of different sounds and pitches by the saxophone 10.

Air introduced into conventional brass saxophones is typically warm, or more specifically at a body temperature of the musician. The introduction of warm air into the conventional brass saxophone generally results in moisture formed by condensation on a relatively cooler inner wall of the conventional brass saxophone. The moisture formed by condensation on the inner wall is generally undesirable. For example, moisture is widely known to adversely affect quality of sound produced by the conventional brass saxophone. In addition, prolonged exposure of a surface, particularly a metal surface or a metal alloy surface, to moisture hastens corrosion of that surface.

In the exemplary embodiment of the present invention, a specially designed feature known as an octave vent 46 seeks to address such a problem of corrosion caused by moisture formation within saxophones.

Figure 6:
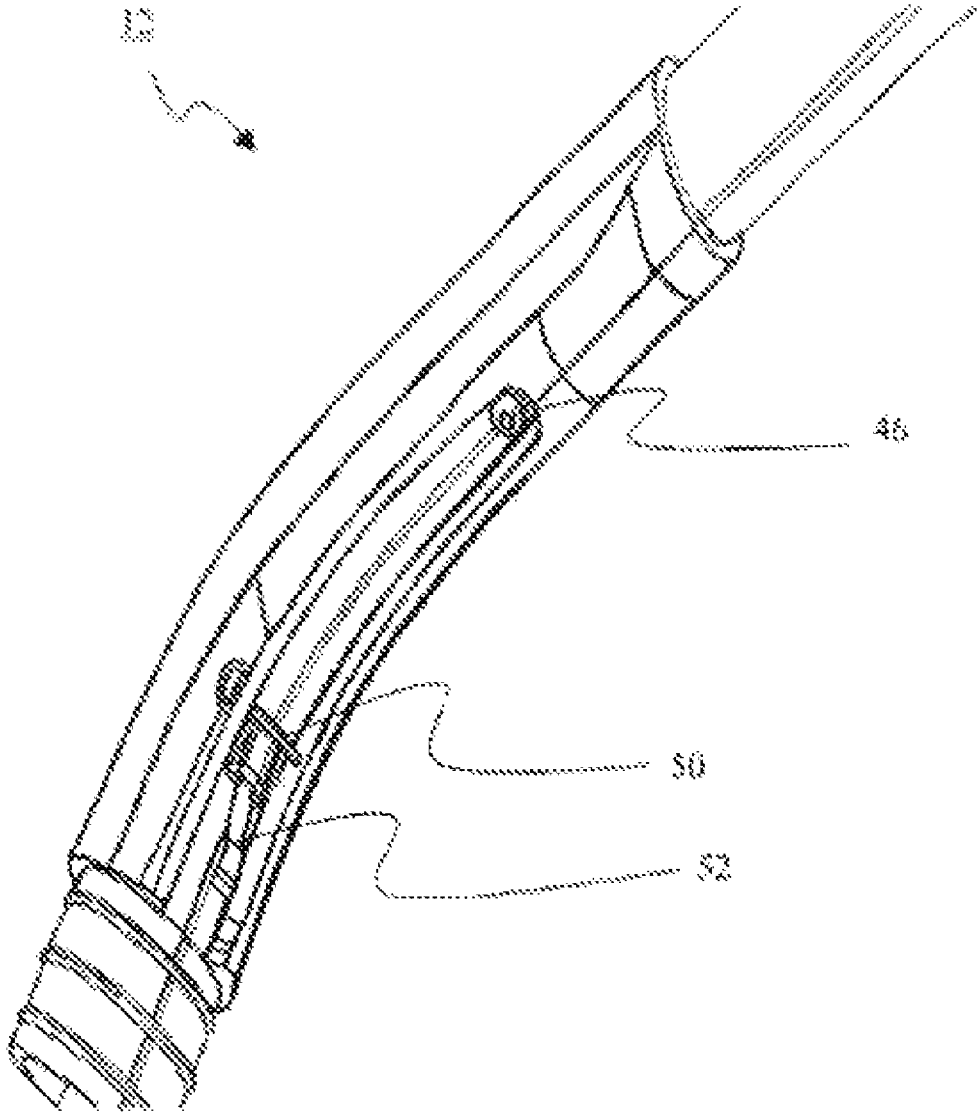
FIG. 6 shows an isometric view of a neck, comprising an octave vent, attachable to the saxophone of FIG. 1.
Figure 7:
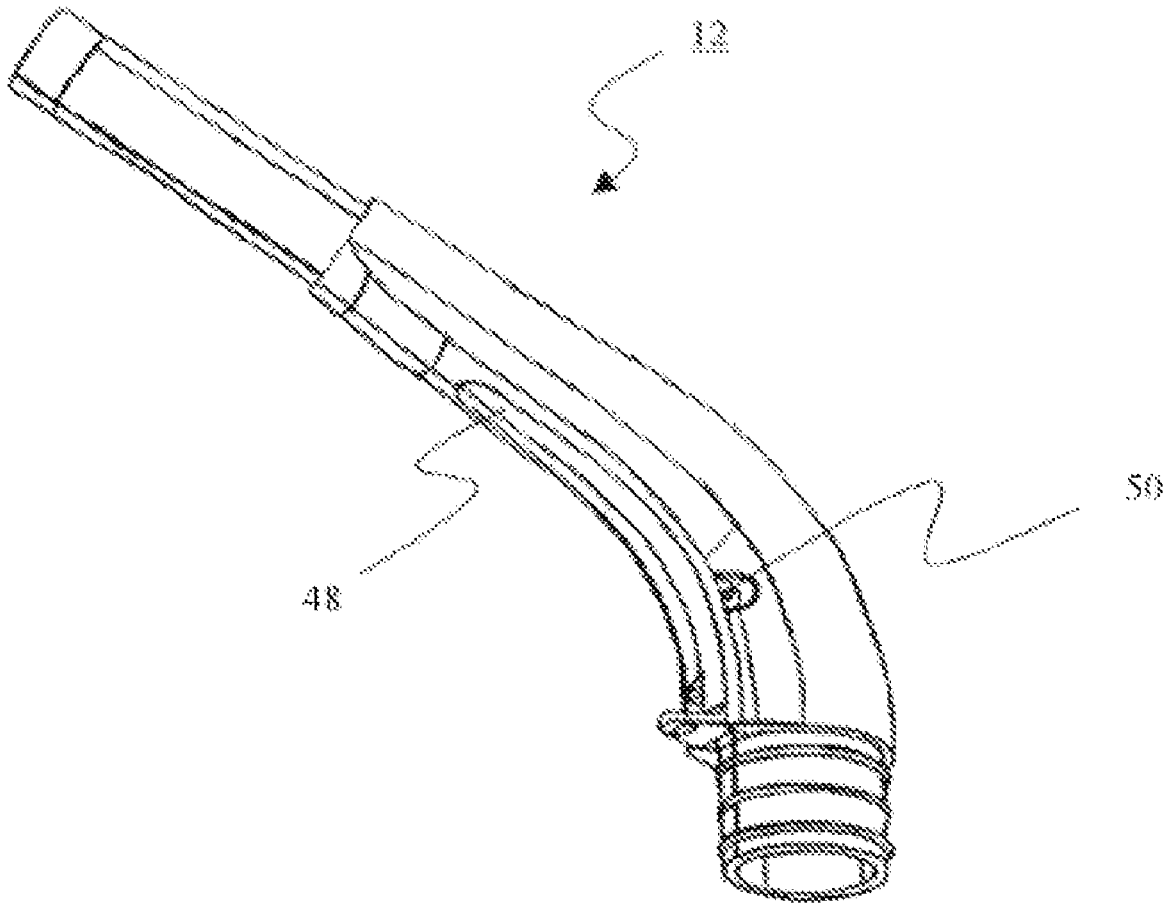
FIG. 7 shows an alternative view of the neck comprising a neck lid for covering the octave vent of FIG. 6.

The octave vent 46 is located at the neck 12 of the saxophone as shown in FIG. 6 and FIG. 7. The neck 12 has a curved profile with a concavity and a convexity. The octave vent 46 is preferably located at the concavity of the neck 12. In a rest state, the octave vent 46 is substantially closed by a neck lid 48. The neck lid 48 is preferably rotatably coupled by a pin 50 to the neck 12 adjacent the octave vent 46. A spring 52, disposed integral the pin 50, biases the neck lid 48 towards a rest state.

The neck lid 48 is maneuverable by the musician to reveal the octave vent 46 as and when required. Preferably, the octave vent 46 is revealed when the neck lid 48 is positioned away from the octave vent 46. To lift the neck lid 48 away from the octave vent 46, force is applied to a vent key (not shown) for compressing the attached spring 52 and positioning the neck lid 48 away from the octave vent 46, thereby revealing the octave vent 46.

A small tube (not shown) is attached to the octave vent 46. The small tube extends into and ends in an interior of the neck 12. The small tube is hollow. The hollow of the small tube facilitates flow of air into and out of the neck 12. Moisture formed within the small tube is removed via the octave vent 46 to an exterior of the saxophone 10. The octave vent 46 is preferably able to reduce moisture leakage from the neck 12 of the saxophone 10.

The neck 12 of the saxophone 10 is removably attachable to the upper body 14. Preferably, the neck 12 is only attached to the upper body 14 just before play of the saxophone 10. Storing and transporting the neck 12 separately from the main frame 10A of the saxophone 10 facilitates easier transport of the saxophone 10. Further preferably, the neck 12 is easily rotated and adjusted within the main frame 10A to suit the musician's playing preference.

Figure 8:
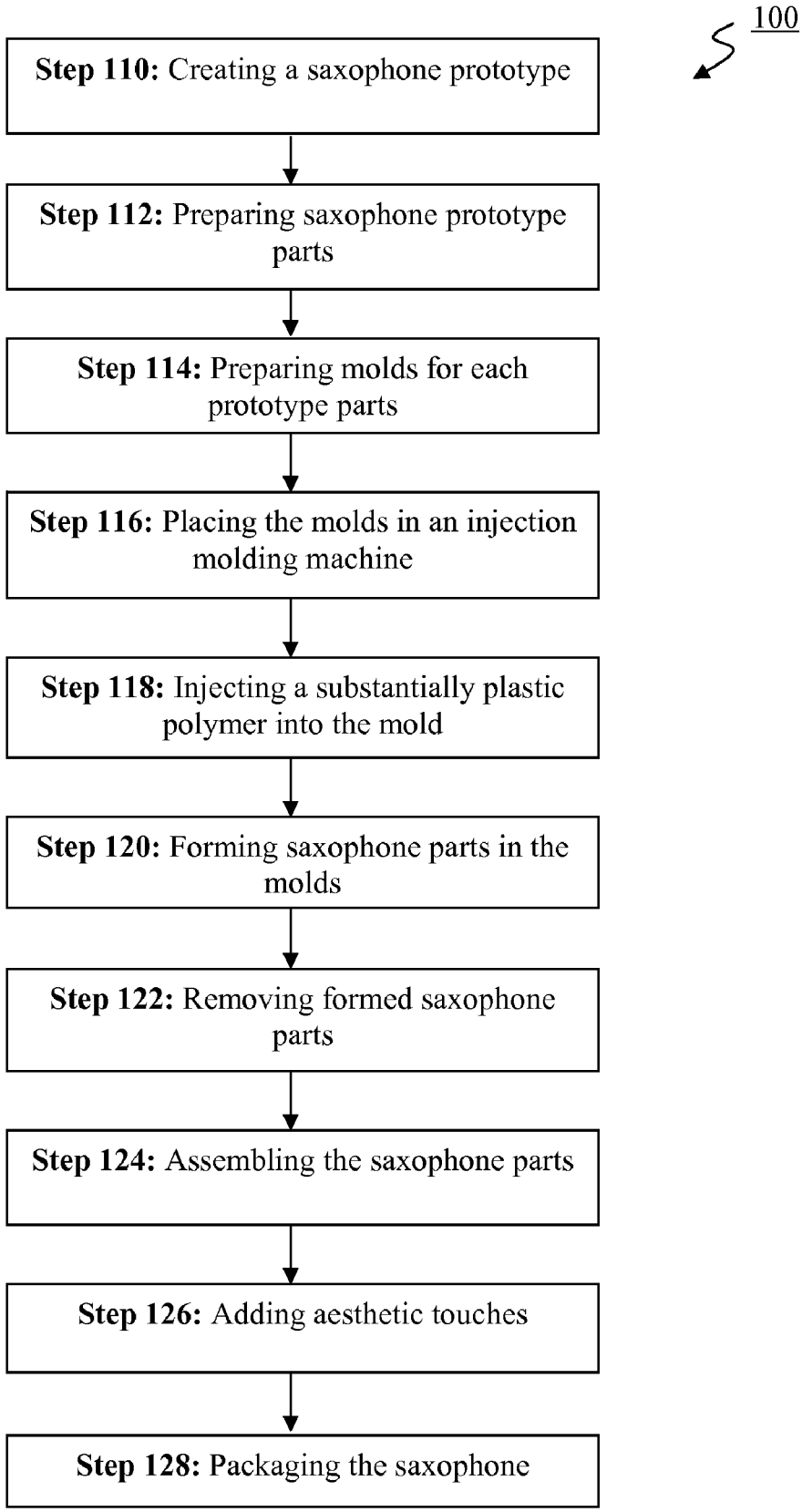
FIG. 8 is a process flow diagram of a method of manufacture of the saxophone of FIG. 1 according to a second embodiment of the invention.

According to a second exemplary embodiment of the present invention, the saxophone 10 is preferably manufactured by a method 100 as illustrated in FIG. 8. In a step 110 of the method 100, a saxophone prototype is created or designed. The saxophone prototype is created or designed by a designer. The designer of the saxophone prototype can be the musician, a buyer, an exporter or an importer of the saxophone 10. Alternatively, the designer of the saxophone prototype is a manufacturer of the saxophone prototype and/or the saxophone 10. The saxophone prototype can incorporate details including, but not limited to, size and proportion of the individual parts of the saxophone 10, size and dimension of the tone holes 22, as well as a shape, size and color of the saxophone 10.

The saxophone prototype comprises a number of prototype parts or components that correspond with different parts of the saxophone 10, including the neck 12, the upper body 14, the main body 16, the left bell and bow 18 and the right bell and bow 20. Preferably, at least one of the prototype parts corresponds with a portion of the keyworks assembly 10B.

The prototype parts are prepared in a step 112. The prototype parts include, but are not limited to, a prototype neck, a prototype upper body, a prototype main body, a prototype left bell and bow and a prototype right bell and bow. The prototype parts can also include prototype keys, prototype tone hole cover structures and prototype tubes.

Each of the prototype parts is specifically shaped and determined to facilitate easy manufacture of its mold and subsequent removal of the corresponding molded saxophone part formed within the mold. For example, a complete bell and bow has a curvature that introduces problems such as complexities in mold manufacture and difficulty in the subsequent removal of the corresponding saxophone part formed within the mold. Designing separate prototype components corresponding with the complete bell and bow, namely the prototype left bell and bow and the prototype right bell and bow, facilitates removal of such problems that are introduced by presence of the curvature.

Molds for each of the prototype parts are then prepared or manufactured in a step 114. Preferably, the molds are metal molds. Alternatively, the molds are made from a different material for example, a metal alloy or a heat-resistant polymer. The molds are essential in ensuring a consistency in size, proportion and quality of all the individual saxophone parts that are subsequently produced using the manufactured molds.

Communication between the designer of the saxophone prototype and the manufacturer of the molds for each of the prototype parts during the step 114 is very important. Preferably, multiple feedback channels or feedback loops are available for enabling refinement of design and details of the saxophone prototype and of the saxophone prototype parts before and during the step 114.

Ensuring a correct and precise proportion and size of each individual mold and therefore of each resultant saxophone part is often crucial for determining quality and even playability of the saxophone 10. For example, each of the number of tone holes 22 is typically required to be of a specific size and proportion in relation to other tone holes 22 in order to ensure production of a correct and precise pitch or sound during play of the saxophone 10. Accordingly, the communication between the designer of the saxophone prototype and the manufacturer of the molds for each of the prototype parts before and during the step 114 is often critical in determining a final quality, and hence retail value, of the saxophone 10.

Once the molds are prepared or manufactured, the molds are then placed into an injection-molding machine in a step 116. Preferably, the injection-molding machine is a plastic or a substantially plastic polymer injection-molding machine. Alternatively, the injection-molding machine is a metal injection-molding machine.

In a step 118, the injection-molding machine injects a molten material into the molds. The molten material is preferably substantially molten plastic polymer. Alternatively, the molten material is a metal, a metal alloy, a synthetic material, a polymer or a combination of any two or more of the following. Preferably, the molten material is colored for providing color to the saxophone 10.

As is well known, injection molding is performed under high pressure. The high pressure in the step 118 ensures that the molten material substantially enters every cavity in the molds. This in turn facilitates a complete and accurate formation of each saxophone part. Additionally, the high pressure utilized in injection molding ensures a rapid injection molding process. Preferably, less than one minute is required for the completion of the step 118.

In the exemplary embodiments described in this document, the substantially molten plastic polymer used for manufacture of the saxophone 10 is preferably Bayblend®. Bayblend® is an amorphous thermoplastic polymer blend made primarily from polycarbonate (PC) and acrylonitrile butadiene styrene (ABS). Some characteristics of Bayblend® include a high heat resistance, a high impact and notched impact strength as well as a high stiffness or rigidity and dimensional stability. Ratio or proportion of PC and ABS can be altered as required. Increasing the proportion of PC in Bayblend® increases the stiffness or rigidity of the saxophone 10. Increasing the proportion of PC can also improve sound resonance and tone quality of the saxophone 10. However, PC is more costly, and therefore, increasing the proportion of PC also increases manufacturing cost of the saxophone 10.

Each of the saxophone parts is then formed in one of the molds in a step 120. This is to say, the saxophone parts such as the neck 12, the upper body 14, the main body 16, the left bell and bow 18 and the right bell and bow 20 are each formed in one of the molds in the step 120. Formed or finished saxophone parts are subsequently removed from the mold in a step 122. The step 122 is preferably done at least one day after the step 120.

The saxophone parts are then assembled together via an assembly process 200 in a step 124. The assembly process 200 is generally performed manually. Preferably, machines, for example a jig, are used to aid the assembly process 200.

Figure 9:
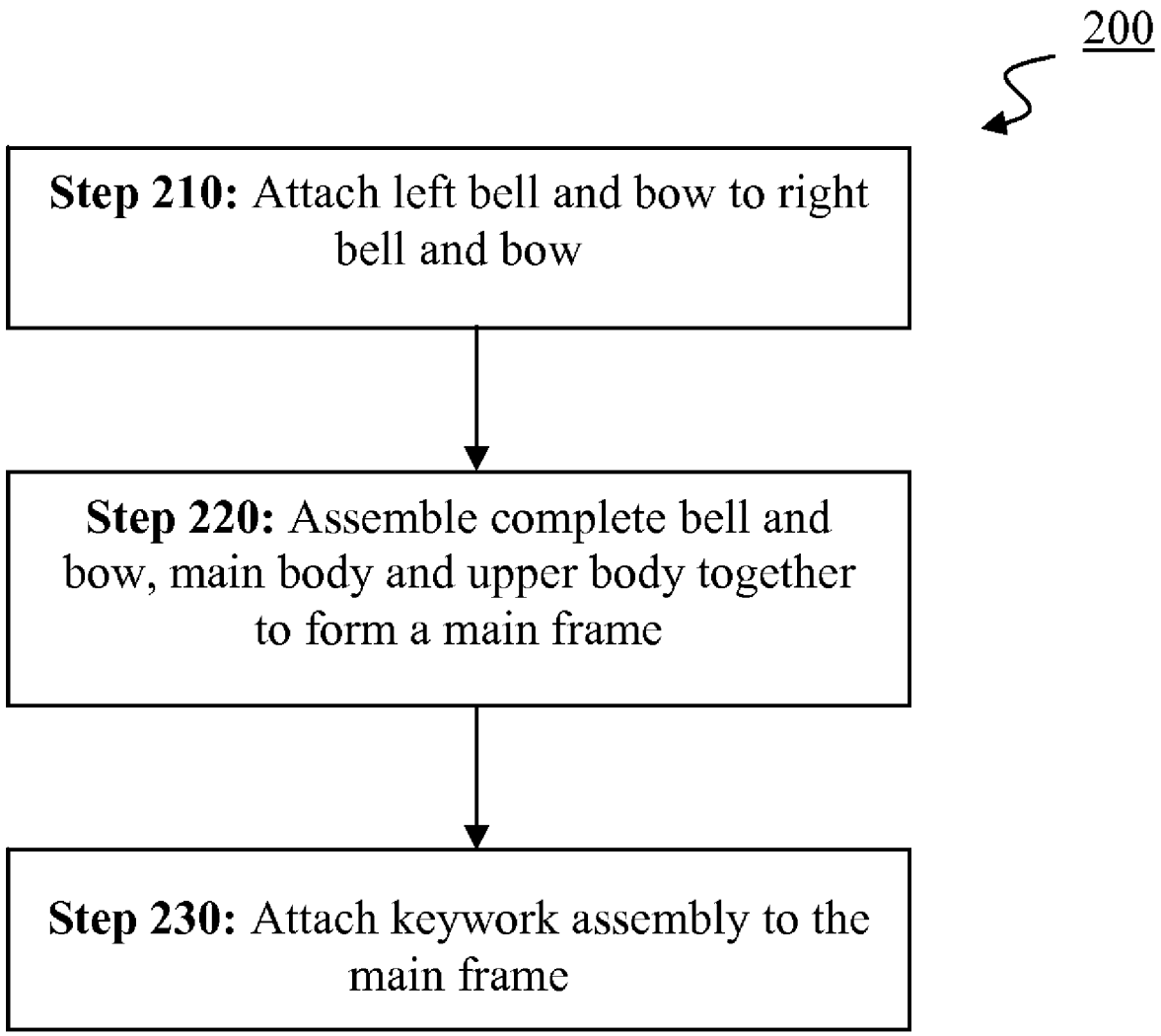
FIG. 9 is a process flow diagram of a method of assembly of parts of the saxophone of FIG. 1.

A sequence of the assembly process 200 is illustrated in FIG. 9. In a step 210 of the assembly process 200, the left bell and bow 18 is attached to the right bell and bow 20 to form the complete bell and bow. Edges of the saxophone parts that come into contact with each other are known as contacting edges. Preferably, adhesive, such as glue, is first applied on the contacting edge of the left bell and bow 18 as well as on the contacting edge of the right bell and bow 20. The jig is preferably used to hold each of the saxophone parts in place during the assembly process. Further preferably, the jig is also used to align the left bell and bow 18 with the right bell and bow 20 so that the contacting edge of the left bell and bow 18 accurately contacts the contacting edge of the right bell and bow 20. The applied adhesive on the contacting edges facilitates secure attachment of the left bell and bow 18 with the right bell and bow 20. Further preferably, the contacting edge of left bell and bow 18 as well as the contacting edge of the right bell and bow 20 are shaped and dimensioned to tightly and precisely fit with and complement each other.

The complete bell and bow, the main body 16 and the upper body 14 are then attached to each other in a step 220. Likewise, the jig can be used to hold and aid assembly of the complete bell and bow, the main body 16 and the upper body 14. Preferably, the contacting edge of each saxophone part are shaped and dimensioned to fit tightly and precisely with that of another saxophone part which it attaches to. The saxophone parts can also be securely attached to each other via a number of small screws. Alternatively, the saxophone parts are securely attached to each other via the adhesive.

Assembly of the complete bell and bow, the main body 16 and the upper body 14 is generally permanent. The complete bell and bow, the main body and the upper body form the main frame 10A of the saxophone 10. As previously mentioned, the main frame 10A of the saxophone 10 defines a central bore through which air that is introduced into the saxophone 10 travels.

The keyworks assembly 10B is then assembled or attached to the main frame 10A of the saxophone 10 in a step 230. Preferably, the rods 38 of the keyworks assembly 10B mediates the attachment of the keyworks assembly 10B to the main frame 10A of the saxophone 10.

As previously mentioned, the rods 38 are preferably made from aluminum. The differing material of the rods 38 from the main frame 10A of the saxophone 10 prevents attachment of the rods 38 to the main frame 10A by welding or soldering. Therefore, the rods 38 are preferably screwed onto the substantially plastic polymer main frame 10A of the saxophone 10. Alternatively, the rods 38 are glued to the substantially plastic main frame 10A of the saxophone 10. Preferably, the attached rods 38 can be easily unscrewed or detached from the main frame 10A as and when required. Therefore, it follows that the keyworks assembly 10B of the saxophone 10 can be easily detached from the main frame 10A of the saxophone 10.

Preferably, the isolated keys 42, the attached keys 44 and the tone hole cover structures 30 are attached to the rods 38 prior to the assembly or attachment of the rods 38 to the main frame 10A. Alternatively the isolated keys 42, the attached keys 44 and the tone hole cover structures 30 are attached to the rods 38 after the assembly or attachment of the rods 38 to the main frame 10A.

The end ring 36 of the tone hole cover structures 30 slide onto, and are thereby securely attached to, the rods 38. Alternatively, the isolated keys 42, the attached keys 44 and the tone hole cover structures 30 are secured to the tubes 38 by use of small screws 40. Further alternatively, adhesives, for example glue, are used to secure the isolated keys 42, the attached keys 44 and the tone hole cover structures 30 to the tubes 38. Generally, the isolated keys 42, the attached keys 44 and the tone hole cover structures 30 can be easily unscrewed and detached from the tubes 38 as and when required.

After the step 124 that results in assembly of the saxophone 10, external aesthetic finishes are then added to the saxophone 10 in a step 126. Such external aesthetic finishes include color markings, straps and ornamental seams. The saxophone 10 is then tested in a step 126. The step 126 is optional. Testing in the step 126 is preferably via a test that is randomly and manually administered. A tuner is preferably used to test or gauge pitch or tones of sounds produced by the saxophone 10 during the test. More preferably, the test is in accordance with a set of pre-determined, internationally recognized standards.

Preferably, only saxophones meeting or surpassing the set of pre-determined, internationally recognized standards of the test are packaged or packed in a step 128. The packaged or packed saxophones are then sold, distributed and/or exported.

Manufacturing saxophones by the method 100 significantly reduces a need for highly skilled and experienced craftsmen. This is because the method 100 is largely automated. Construction of molds for each of a typically large number of individual saxophone parts ensures consistency in the size, shape and quality of the saxophone parts produced. In addition, the reduction in the need for highly skilled and experienced craftsmen results in a significant decrease in manufacturing cost and consequent retail price. Furthermore, the manufacture of saxophones by injection molding enables saxophones to be made from materials such as plastic polymers and other thermo-resistant synthetic materials. Compared with conventional brass saxophones, saxophones made from plastic polymers are significantly lighter, and are therefore easier to transport and to play. Additionally, such plastic polymer saxophones are also more resistant to corrosion, and are hence more durable, than the conventional brass saxophones.

In the foregoing manner, a saxophone and a method of manufacture of the saxophone are described according to exemplary embodiments of the invention for addressing shortcomings of existing saxophones and their methods of manufacture. Although only embodiments of the invention are disclosed, it will be apparent to one skilled in the art in view of this disclosure that numerous changes and/or modifications can be made without departing from the scope and spirit of the invention.

The invention claimed is:

1. A saxophone comprising:

an injection molded main frame defining a bore and having a plurality of tone holes formed therein, each tone hole having a predetermined shape and dimension, the main frame comprising a plurality of intercouplable injection molded parts;

an injection molded detachable neck couplable to the injection molded main frame and comprising a plastic polymer; and a substantially injection molded keyworks assembly couplable to the main frame, the keyworks assembly comprising:

a plurality of rods, each of the plurality of rods having an off-circular length transverse cross-sectional shape; and a plurality of injection molded tone hole cover structures couplable to the plurality of rods, each of the plurality of tone hole cover structures comprising:

a lid having a shape and dimension corresponding to a tone hole; and an end ring having a hole which shape matches the transverse cross-sectional shape of at least one of the plurality of rods, wherein a displacement of one of the plurality of rods can displace a lid within the plurality of tone hole cover structures to vary a tone hole between an open state and a closed state.

2. The saxophone as in claim 1, wherein each of the plurality of intercouplable injection molded parts is made substantially from one of a plastic polymer, a metal and a heat-resistant synthetic material.

3. The saxophone as in claim 1, wherein the injection molded detachable neck comprises a crook and an octave vent.

4. The saxophone as in claim 1, wherein the substantially injection molded keyworks assembly further comprises:

a plurality of keys, each of the plurality of keys being couplable to at least one of the plurality of injection molded tone hole cover structures one of directly and via one of the plurality of rods and displaceable for controlling displacement of the at least one of the plurality of injection molded tone hole cover structures, wherein at least one of the plurality of keys is biased to a rest state to thereby bias the at least one of the plurality of injection molded tone hole cover structures in one of towards and away from at least one of the plurality of holes corresponding thereto.

5. The saxophone as in claim 1, wherein each of the plurality of injection molded tone hole cover structures is of a plastic polymer blend that substantially comprises polycarbonate and acrylonitrile butadiene styrene.

6. The saxophone as in claim 1, wherein the hole of the end ring of at least one of the plurality of injection molded tone hole cover structures shape matches the cross-sectional shape of the at least one of the plurality of rods to restrict free rotation of the at least one of the plurality of injection molded tone hole cover structures about a length of the at least one of the plurality of rods when the at least one of the plurality of rods is fitted within the hole of the end ring of the at least one of the plurality of injection molded tone hole cover structures.

7. The saxophone as in claim 1, wherein the end hole of the end ring of each of the plurality of injection molded tone hole cover structures is substantially one of triangular, square, pentagonal, hexagonal and heptagonal in shape and the cross-sectional shape of the at least one of the plurality of rods is substantially one of triangular, square, pentagonal, hexagonal and heptagonal.

8. The saxophone as in claim 1, wherein at least one of the plurality of rods is made substantially from one of a metal, an alloy, a non-metallic material and a metal reinforced material having heat resistant properties.

9. A method for manufacturing a reed instrument, the method comprising:

injection molding a plurality of reed instrument frame parts; assembling the plurality of reed instrument frame parts to form a main frame, the main frame defining a bore and having a plurality of tone holes formed therein for fluid communicating with the bore;

injection molding a detachable neck comprising a plastic polymer that is couplable to the main frame;

injection molding a plurality of tone hole cover structures comprising a plastic polymer, the tone hole cover structures corresponding to the tone holes on the main frame;

providing a keyworks comprising:

a plurality of rods, each rod within the plurality of rods having an off-circular length transverse cross-sectional shape; and a plurality of tone hole cover structures, each of the plurality of tone hole cover structures comprising an end ring having a hole shape matched to a transverse cross-sectional shape of at least one of the plurality of rods;

coupling the end rings of the tone hole cover structures to a rod within the plurality of rods; and coupling the keyworks assembly to the main flame such that a displacement of a rod within the plurality of rods displaces a tone hole cover structure within the plurality of tone hole cover structures to vary a tone hole between an open state and a closed state.

10. The saxophone as in claim 2, wherein each of the plurality of intercouplable injection molded parts and the injection molded detachable neck is made of a plastic polymer blend that substantially comprises polycarbonate and acrylonitrile butadiene styrene.

11. The method of claim 9, wherein providing the keyworks assembly comprises each tone hole cover structure within the plurality of tone hole cover structures comprising: a lid having a shape and dimension corresponding to a tone hole.

12. The saxophone as in claim 1, wherein the at least one of the plurality of rods has a hollow defined therein for receiving at least one shaft therewithin, the at least one shaft being made substantially from one of stainless steel, an alloy, a non-metallic material or a metal reinforced material.

13. The method as in claim 9, further comprising:

designing and creating a prototype of the reed instrument, the prototype comprising a plurality of prototype parts, each of the plurality of prototype parts corresponding with one of the plurality of reed instrument frame parts; and fabricating a plurality of molds using the plurality of prototype parts for facilitating formation of the plurality of reed instrument frame parts via injection molding.

14. The method as in claim 9, wherein injection molding the plurality of reed instrument frame parts comprises:

injecting a substantially molten material into each of the plurality of molds, wherein the injected substantially molten material within each of the plurality of molds thereinafter solidifies to form one of the plurality of reed instrument frame parts.

15. The method as in claim 14, wherein the substantially molten material is one of a plastic polymer and a heat-resistant synthetic material and wherein each of the plurality of rods is made substantially from one of a metal, an alloy, a non-metallic material and a metal reinforced material.

16. The method as in claim 9, wherein injection molding the detachable neck comprising comprises:

injection molding the detachable neck comprising a crook and an octave vent, the octave vent configured and operable for reducing moisture seepage from within an interior of the mainframe when the detachable neck is coupled thereto.

17. The method as in claim 9, coupling the keyworks assembly to the main frame further comprising:

inserting and securing the at least one of the plurality of rods through the end hole of at least one of the plurality of tone hole cover structures corresponding thereto; and coupling each of a plurality of keys to at least one of the plurality of tone hole cover structures one of directly and via the at least one of the plurality of rods and operable for controlling displacement of the at least one of the plurality of tone hole cover structures.

18. The method as in claim 9, wherein the hole of the end ring of at least one of the plurality of tone hole cover structures shape matches the cross-sectional shape of the at least one of the plurality of rods fined therewithin to thereby restrict free rotation of the at least one of the plurality of tone hole cover structures about a length of the one of the plurality of rods.

19. The method as in claim 9, wherein the hole of each end ring of the plurality of tone hole cover structures is substantially one of triangular, square, pentagonal, hexagonal and heptagonal in shape and the cross-sectional shape of each of the plurality of rods is substantially one of triangular, square, pentagonal, hexagonal and heptagonal.

20. The method as in claim 9, wherein at least one of the plurality of rods has a hollow defined therein for receiving at least one shaft therewithin, the at least one shaft received in the hollow of the at least one of the plurality of rods being made substantially from one of stainless steel, an alloy, a non-metallic material or a metal reinforced material.

21. The method as in claim 9, further comprising: providing a plastic polymer blend substantially made of polycarbonate and acrylonitrile butadiene styrene for use in injection molding at least one of the plurality of reed instrument frame parts, the detachable neck, and the plurality of tone hole cover structures.

22. A saxophone comprising:

an injection molded main frame defining a bore and having a plurality of tone holes formed therein, each tone hole having a predetermined shape and dimension, the main frame comprising a plurality of intercouplable injection molded parts;

an injection molded detachable crooked neck couplable to the injection molded main frame and comprising a plastic polymer; and a substantially injection molded keyworks assembly couplable to the main frame, the keyworks assembly comprising:

a plurality of rods, each of the plurality of rods having an off-circular length transverse cross-sectional shape; and a plurality of injection molded tone hole cover structures couplable to the plurality of rods, each of the plurality of tone hole cover structures comprising:

a lid having a shape and dimension corresponding to a tone hole; and an end ring having a hole which shape matches the transverse cross-sectional shape of at least one of the plurality of rods, wherein at least one of the injection molded main frame, the injection molded detachable neck and the plurality of injection molded tone hole cover structures is made from a plastic polymer blend of substantially polycarbonate and acrylonitrile butadiene.

* * * * *